US010921012B1

(12) United States Patent
Walton et al.

(10) Patent No.: US 10,921,012 B1
(45) Date of Patent: Feb. 16, 2021

(54) SYSTEM AND METHOD FOR COMPRESSOR OPTIMIZATION AND SYSTEM CYCLING USING AMBIENT AIR FOR COOLING OR HEATING

(71) Applicant: EnTouch Controls Inc., Richardson, TX (US)

(72) Inventors: James R. Walton, Murphy, TX (US); Frank I. Menocal, Plano, TX (US); Tejasbhai D. Patel, Allen, TX (US)

(73) Assignee: EnTouch Controls Inc., Richardson, TX (US)

( * ) Notice: Subject to any disclaimer, the term of this patent is extended or adjusted under 35 U.S.C. 154(b) by 0 days.

(21) Appl. No.: 15/450,772

(22) Filed: Mar. 6, 2017

(51) Int. Cl.

| | |
|---|---|
| ***F24F 11/76*** | (2018.01) |
| ***F24F 11/30*** | (2018.01) |
| ***F24F 11/83*** | (2018.01) |
| *F24F 110/12* | (2018.01) |
| *F24F 11/85* | (2018.01) |
| *F24F 140/20* | (2018.01) |
| *F24F 110/10* | (2018.01) |
| *F24F 110/40* | (2018.01) |

(52) U.S. Cl.
CPC ..... *F24F 11/76* (2018.01); *F24F 11/30* (2018.01); *F24F 11/83* (2018.01); *F24F 11/85* (2018.01); *F24F 2110/10* (2018.01); *F24F 2110/12* (2018.01); *F24F 2110/40* (2018.01); *F24F 2140/20* (2018.01); *F24F 2203/104* (2013.01)

(58) Field of Classification Search
CPC .. F24F 11/76; F24F 11/83; F24F 11/30; F24F 2110/10; F24F 2110/12
USPC ..... 62/228.1
See application file for complete search history.

(56) References Cited

U.S. PATENT DOCUMENTS

| | | | | | |
|---|---|---|---|---|---|
| 4,258,553 | A * | 3/1981 | Kelly | F25B 41/04 | 62/117 |
| 4,501,125 | A * | 2/1985 | Han | F25B 49/02 | 62/175 |
| 4,570,448 | A * | 2/1986 | Smith | F25D 16/00 | 62/89 |
| 6,170,271 | B1 * | 1/2001 | Sullivan | F24F 3/153 | 62/176.1 |
| 6,491,094 | B2 * | 12/2002 | Rayburn | F24F 3/044 | 165/250 |
| 9,982,903 | B1 * | 5/2018 | Ridder | F24F 11/30 | |
| 2003/0094006 | A1 * | 5/2003 | Des Champs | F24F 1/027 | 62/186 |
| 2009/0210096 | A1 * | 8/2009 | Stack | F24F 11/30 | 700/278 |
| 2010/0307175 | A1 * | 12/2010 | Teige | F24F 3/1423 | 62/94 |

(Continued)

*Primary Examiner* — Henry T Crenshaw
(74) *Attorney, Agent, or Firm* — Frost Brown Todd LLC

(57) ABSTRACT

A system and method are described for conserving energy in HVAC systems. During certain temperature requests, ambient air can be supplied to a conditioned space and the HVAC compressor can be turned off to conserve power. During certain temperature requests, supply air can be adjusted through cycling of heating or cooling elements to conserve power and maintain desired space temperature. In various embodiments, supply air temperature, coil temperature, cabinet temperature and other values can be monitored for their effect on cooling and/or heating, and taken into account for determining how to best cool or heat a conditioned space.

14 Claims, 7 Drawing Sheets

(56) References Cited

U.S. PATENT DOCUMENTS

| | | | | |
|---|---|---|---|---|
| 2011/0011125 | A1* | 1/2011 | Kasahara | F25B 49/02 62/498 |
| 2011/0083454 | A1* | 4/2011 | Kopko | F25B 49/027 62/115 |
| 2012/0171943 | A1* | 7/2012 | Dunnavant | H05K 7/20745 454/184 |
| 2013/0105104 | A1* | 5/2013 | Wiley | F28D 21/0014 165/8 |
| 2013/0324027 | A1* | 12/2013 | Davis | F24F 11/0001 454/258 |
| 2014/0190198 | A1* | 7/2014 | Slessman | H05K 7/20745 62/314 |
| 2016/0327297 | A1* | 11/2016 | Song | F24F 11/30 |
| 2017/0276571 | A1* | 9/2017 | Vitullo | G05B 23/0248 |
| 2017/0321917 | A1* | 11/2017 | Nickel | F24F 11/62 |

* cited by examiner

SYSTEM AND METHOD FOR COMPRESSOR OPTIMIZATION AND SYSTEM CYCLING USING AMBIENT AIR FOR COOLING OR HEATING

TECHNICAL FIELD

The present disclosure is directed to HVAC operations and in particular to compressor optimization and system cycling.

BACKGROUND OF THE INVENTION

HVAC systems sometimes take advantage of tools called economizers. Economizers function by supplying outside air to a space when doing so will save energy. For example, if there is a demand for cool air to a space, and the outside air is sufficiently cool, then the economizer will open a gate or air damper to direct outside air to a building/room/etc. Economizers save money and energy by using ambient air instead of depending on the outputs of an HVAC circuit.

BRIEF SUMMARY OF THE INVENTION

A possible embodiment under the present disclosure can comprise a method for operating an HVAC system comprising a heat exchanging coil, one or more compressors, and an HVAC controller, the method comprising: receiving, at the HVAC controller, a temperature request for a climate controlled space; determining a basis air temperature of the climate controlled space using a sensor in the climate controlled space; determining an ambient air temperature; determining that ambient air can be used to fulfill the temperature request without compressor operation; restricting operation of a compressor; supplying ambient air to the climate controlled space; determining a supply air temperature using a sensor in the supply airstream; determining a current temperature of the climate controlled space; and adjusting an operation of the HVAC system based on at least the determined supply air temperature, the determined current temperature of the climate controlled space, and the determined ambient temperature.

Another possible embodiment comprises a method of operating an HVAC system comprising a heat exchanging coil, one or more compressors, and an HVAC controller, the method comprising: determining a temperature of a climate controlled space; receiving a request to lower the determined temperature to a chosen temperature; determining an ambient temperature; determining that the determined ambient temperature is less than the determined temperature of the climate controlled space; restricting operation of a compressor within the HVAC system; allowing an ambient air to comprise a portion of the supply air of the HVAC system; determining a change in a temperature of the supply air, the climate controlled space, or the ambient temperature; and adjusting an operation of the HVAC system based on at least the determined change in the temperature of the supply air, the climate controlled space, or the ambient temperature.

Another possible embodiment under the present disclosure can comprise an HVAC system for providing conditioned air to a space, comprising: a cabinet comprising; an inlet for an ambient airstream; a supply airstream; a return airstream; and at least one heat exchanger; an ambient temperature sensor; a supply air temperature sensor; a space temperature sensor; a thermostat coupled to the cabinet, ambient temperature sensor, supply air temperature sensor, and the space temperature sensor and configured to receive a temperature request, wherein when the request is to heat the space when the determined ambient temperature is greater than the determined temperature of the space or to cool the space when the determined ambient temperature is less than the determined temperature of the space, the thermostat is configured to; restrict operation of a compressor within the HVAC system; allow an ambient air to comprise a supply air of the HVAC system; determine a change in a temperature of the supply air; determine a change in the temperature of the space; determine a change in the ambient temperature; and adjust an operation of the HVAC system based on at least the determined change in the temperature of the supply air, the determined change in the temperature of the space, and the determined change in the ambient temperature.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
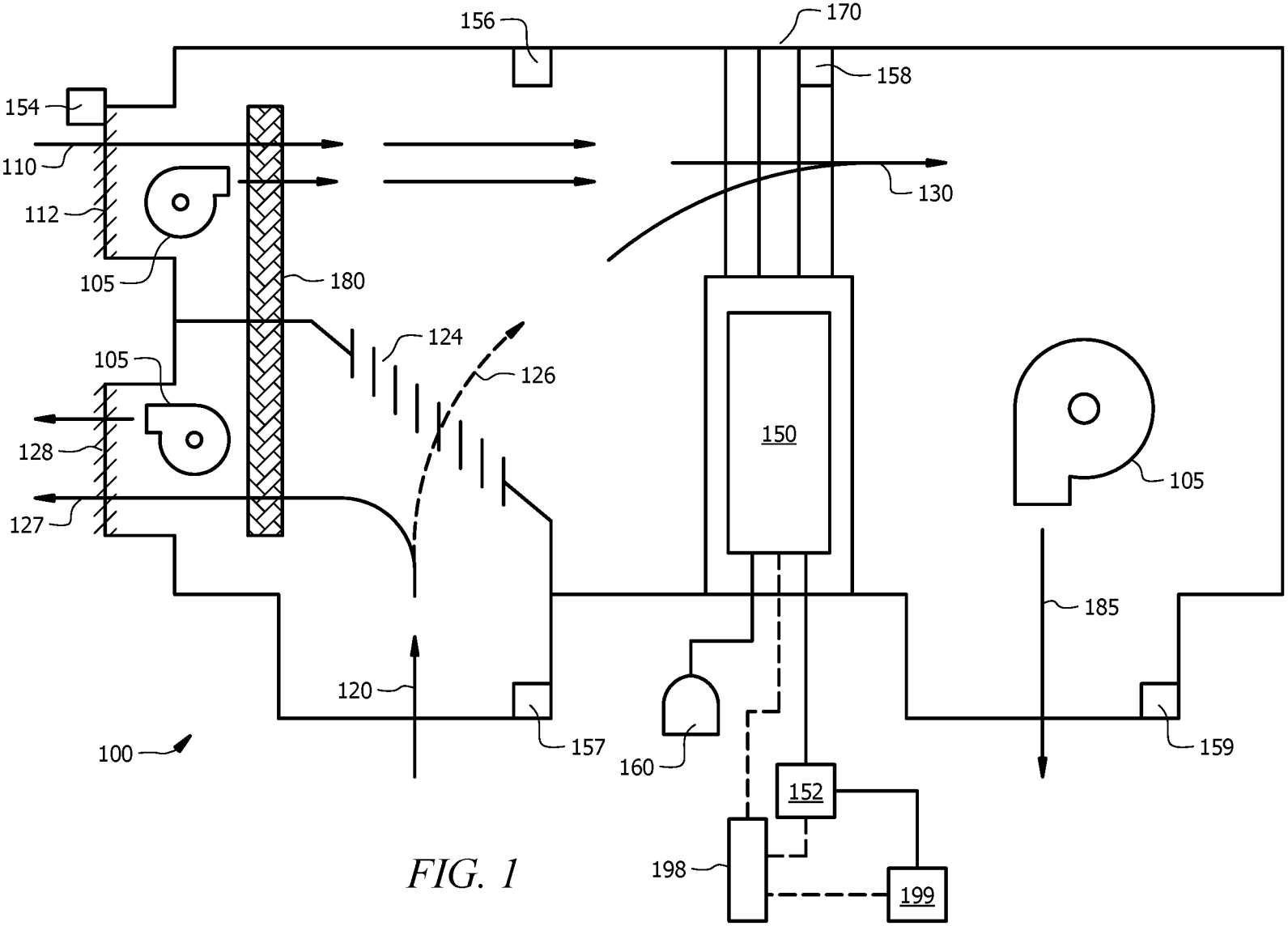
FIG. 1 is a diagram of a possible system embodiment under the present disclosure.

There are a couple of products on the market that are designed to interrupt the compressor signal from a thermostat to help optimize the energy of an HVAC system. These include economizers which are found in many commercial HVAC systems that are designed to fully break the compressor control signals and open an air damper to allow the intake of fresh air when the outside conditions are within acceptable range. The other products on the market have been designed for residential applications where they are inline with the compressor signal calls to disengage the compressor based on the supply air (or discharge air) temperature reaching a pre-defined point and then allowing the compressor to re-engage once the supply air has increased to another pre-defined temperature. The supply air monitoring point is typically mounted directly on the cooling coils of the HVAC equipment. This solution has no knowledge of the interior temperatures or no control over the individual stages of the HVAC system.

Another type of prior art is a process known as a supply air temperature reset which is found in larger building automation systems that have chillers as their primary cooling source. This solution adjusts the supply air temperature by controlling the cooling loop of either the chilled water or the compressors of a chiller. This process is programmed from a central controller in a BMS/BAS/EMS system that communicates directly with the chiller. In the prior art, one disadvantage is that thermostats and controllers are separate and there is no intelligence between them. Therefore, the interior temperatures have the potential not to be maintained as the prior art does not have the ability to disengage its process. Additionally, prior art systems for compressor cycling are designed for residential applications that only have a single stage cooling process. When these products are used in commercial applications they connect all stages of cooling together which forces the HVAC to have a higher cycle rate. This process also has the potential for increasing humidity. The conventional approach only works with cooling systems whereas the current disclosure has solutions which work with both cooling and heating processes.

One embodiment of a solution under the present disclosure is a solution utilizing thermostats and controllers that optimize the energy of an HVAC system using the supply air temperature, interior temperature and individual control of each HVAC stage. The system can use pre-defined set points and can also use built-in intelligence to determine the optimal minimal supply air temperature that the HVAC system can produce. While prior art systems required that air sensors be placed in the HVAC cabinet on a coil, solutions under the present disclosure can comprise air sensors mounted in various locations in and about the HVAC system. Sensors can be wired or wireless, or combinations of the two. The present disclosure can be implemented with conventional cooling systems as well as heat pumps for both cooling and heating cycles. Another advantage under the present disclosure is that some embodiments can have the intelligence to learn the optimal supply air temperature. A system under the present disclosure can therefore act as a free air cooling system simulating an economizer when the unit has a permanent fresh air intake. Embodiments can therefore act to modulate the supply air temperature to maintain proper interior temperatures, reduce compressor runtime, reduce system energy use, and reduce system peak demand while ensuring that the compressors are not short cycling. Solutions under the present disclosure can be enhanced by applying similar algorithms to additional cooling and heating stages in an HVAC system.

An embodiment of an HVAC system can be seen in FIG. 1. System 100 comprises a return airstream 120, supply airstream 185, and outside airstream 110. Inlet 112 for outside air 110 comprises a gate that can be open and closed. Blower 105 directs outside air through the system 100. Enthalpy wheel 180 (or other type of heat exchanger) spans both the outside air 110 and return air 120/exhaust air 127. Enthalpy wheel 180 may be optional or turned off in some embodiments. Return air 120 enters system 100 and can then split into exhaust airstream 127 and recycle airstream 126. Gate 124 can open and close. When open, all or part of airstream 120 will be directed back into the system 100 (recycle airstream 126). When closed, all of return air 120 will become exhaust air 127. Blower 105 assists in the movement of return air 120 and exhaust air 127. Outlet 128 comprises a gate that can open and close. Outside air 110 (and in some situations recycle air 126) forms primary airstream 130 which passes through cooling coil 170. Blower 105 helps in directing primary airstream 130 into supply airstream 185.

System 100 can comprise controlling circuitry 150. Controller 150 comprises a connection (wired or wireless) to a thermostat 152, likely located elsewhere within a building. Thermostat 152 can comprise more or less control over HVAC system 100 than the controller 150. Intelligence and processing power can also be distributed among thermostat 152, controller 150, or even other components of system 100. Portions of the system can also be cloud based, wherein storage, processing, or other functions take place remotely, in the cloud. Thermostat 152 can comprise a temperature sensor (or a connection to a temperature sensor or sensor array, or other types of sensors) within a conditioned or heated space. Controller 150 also connects to compressor 160. Compressor 160 can comprise connections to HVAC components such as coil 170, heat exchangers, expansion devices, refrigerant lines, and more (most of these components are not shown in FIG. 1 for the sake of clarity). Controller 150 can comprise connections to temperature, humidity, or other sensors 154, 156, 157, 158, 159, 199 and other components within the system 100 and the broader HVAC footprint at a given location. Connections between the various components described can be wired or wireless (such as cellular, Bluetooth, or WiFi). Furthermore, some components can be remote from the others. Thermostat 152, sensors 154, 156, 157, 158, 159, 199 or other components, can be remote. Components described can also comprise arrays of the named component. For example, sensors 154, 156, 157, 158 can each comprise sensor arrays. Ambient sensor 154 can be web-based, or remote, or provided by a third party, in some embodiments. Remote sensor 199 can comprise a remote sensor located far from the physical footprint of system 100. Remote system 199 can comprise a wired or wireless connection to thermostat 152.

HVAC system 100 can comprise one or more sensors 154, 156, 157, 158, 159 and 199, any of which can comprise connections to controller 150 or thermostat 152. Temperature sensor 154 can detect ambient temperature. Sensor 156 can detect temperature within the HVAC system. Sensor 157 can detect return air temperature. Sensor 158 can detect temperature within the coil 170. Sensor 159 can detect temperature within the supply airstream 185. Prior art systems typically only comprised a single temperature sensor, usually an ambient temperature sensor or a sensor within the cooling coil. Embodiments under the present disclosure can comprise multiple temperature sensors—any or all of sensors 154, 156, 157, 158, 159, 199 or any combination thereof. A preferred embodiment comprises a temperature sensor 159 for the supply air 185, an ambient sensor 154, and/or room sensors 152/199.

During certain cooling or heating situations, an HVAC system can be designed to supply outside air to the conditioned space instead of heating or cooling air during the HVAC cycle. Typically, these scenarios arise when there is a demand to cool a space, and the outside air is cooler than the space's current temperature. Another example is when there is a demand for heating and the outside air is hotter than the space.

A typical economizer in the prior art will only look at ambient temperature. One possible disadvantage of prior art systems can be increased humidity. Another prior art scenario involves only the use of the coil temperature. A typical downside of this process is that the compressor tends to cycle on and off frequently. Such cycling can result in pressure drops and spikes and can degrade equipment quickly. These prior art processes typically comprise a direct connection between the temperature sensor and the control of the outside air supply, such that there is a temperature switch. The system is automatic and does not take into account other factors, such as additional temperature readings from elsewhere in the system.

Embodiments under the present disclosure can use multiple temperature readings including ambient air (sensor 154), temperature within an HVAC cabinet or rooftop unit (sensor 156), coil (sensor 158), return air (sensor 157), supply air (sensor 159), and/or remote sensor 199. Any combination of the foregoing, as well as other temperatures, can be used. Preferred embodiments will use at least the supply air temperature and at least one other temperature reading. Solutions under the present disclosure can store temperature readings for sensors 154, 156, 157, 158, 158, 199 (or readings from other sensors), along with records of compressor cycling, temperatures inside the conditioned space (such as at thermostat 152). In this manner the system can learn how the different input values yield various results. Most embodiments will comprise a temperature sensor 159 for the supply air. Because the system knows the supply air it can better understand how outside air temperature, coil temperature, or other factors contribute to the resulting supply air. Temperature measurements within the space tend to be better correlated with supply air temperature than, for example, coil temperature or ambient temperature.

Embodiments under the present disclosure can use the supply air temperature to determine when the HVAC compressor can be turned off to extract the maximum amount of energy from the coils. Once the supply air reaches saturation point, a stage one cooling signal can be released. The compressor can re-engage once the energy has been falling or compressor time-out has been reached, whichever one is longer. Functionality can be disabled when additional stages of cooling are needed. The functionality can also apply to heat-pump systems for heating.

Controller 150 and thermostat 152 can share controlling capabilities, or one or the other may control system 100. When controller 150 or thermostat 152 receive a command for a certain level of cooling or heating, they can detect the supply air temperature at sensor 159 and within the space at thermostat 152 (or other temperatures such as any or multiple of temperatures at sensors 154, 156, 157, 158, 199). Over time, controller 150 and/or thermostat 152 can learn what inputs lead to a given output temperature. Controller 150 and/or thermostat 152 can react accordingly by performing various actions, including examples such as: open or close inlet 112, turn on or off coil 170, open or close gate 124, open or close outlet 128, turn on or off blowers 105, turn on or off compressor 160 and more.

Some embodiments of system 100 can comprise a head end controller 198, or other type of controller that interfaces with a pre-existing system 100. For example, head end controller can comprise a connection to any one of controller 150, thermostat 152, or sensor 199. Head end controller 198 can comprise circuitry operable to interface with any of elements 150, 152, 199 and thereby communicate and interact with system 100. One example of a head end controller 198 is a JACE (Java Application Control Engine). A head end controller 198 may be useful in many situations, for example, a situation with a pre-existing HVAC system 100 that lacks certain features, such as those described in the present disclosure. A head end controller 198 can be installed and can be used to direct the activities of system 100.

A possible embodiment under the present disclosure can comprise the following. Thermostat 152 receives a command for setting the temperature within a space to 70° F. If the outside air at sensor 154 is 90° F., then thermostat 152 will send a command directing components 160, 170 of the HVAC cycle to turn on, or increase load, or decrease load. If outside air is 65° F., then thermostat 152 will command compressor 160 to turn off, therefore ending heat transfer across coil 170. Outside air 110 will enter the system and supply the bulk or all of the supply airstream 185. This will cool the conditioned space until the temperature equals 70° F. In this scenario, for example, supply air may measure at 68° F., at sensor 159. During this process, recycled air 126 may be used as well. Thermostat 152 can determine how much, if any, recycled air 126 to use, and may close and open gate 124 accordingly. Similarly, thermostat 152 can turn on and off enthalpy wheel 180. Thermostat 152 can make these adjustments based on set standards within software or hardware, or it may use historical data about how temperatures of 70 F within a space relate to supply air temperature at sensor 159, and ambient air temperature at sensor 154.

In another situation, a command for heating may be received at thermostat 152. For example, temperature in a space may be 65° F., and thermostat 152 may be set raise the temperature to 75° F. If the outside air, measured at sensor 154, is 50° F., then thermostat 152 (or controller 150) will direct the system to begin a heating cycle. However, if outside air is 85° F., then the thermostat 152 (or controller 150) can direct the system to use outside air 110 to provide supply air 185. Doing so may or may not include mixing with return air 120 and recycled air 126. How much outside air 110, how much recycled air 126, how long for each air stream, and other factors, can be determined by temperature readings at thermostat 152, temperature readings at sensor 159, and/or other temperature readings. In addition, thermostat 152 and/or controller 150 can make adjustments based on saved values/settings in memory, or on the basis of historical data maintained by the thermostat 152 (or controller 150, or a cloud-based server connected to thermostat 152), dealing with relations among the different sensors and system behavior. For example, thermostat 152 and/or controller 150 may save data on how outside air temperature affects supply air temperature depending on whether the compressor is running or not, whether return air is recycled, or other factors. Relationships among any of the sensors 152, 154, 156, 157, 158, 159 can be used. Any of the sensors 152, 154, 156, 157, 158, 159, 199 can also (or alternatively) comprise humidity, pressure, or other sensors, or any combination thereof. These values can be used as well to predict the effects of different actions. For example, high or low humidity readings within the conditioned space can cause the thermostat 152/controller 150 to power on or off the coil 170.

Figure 7:
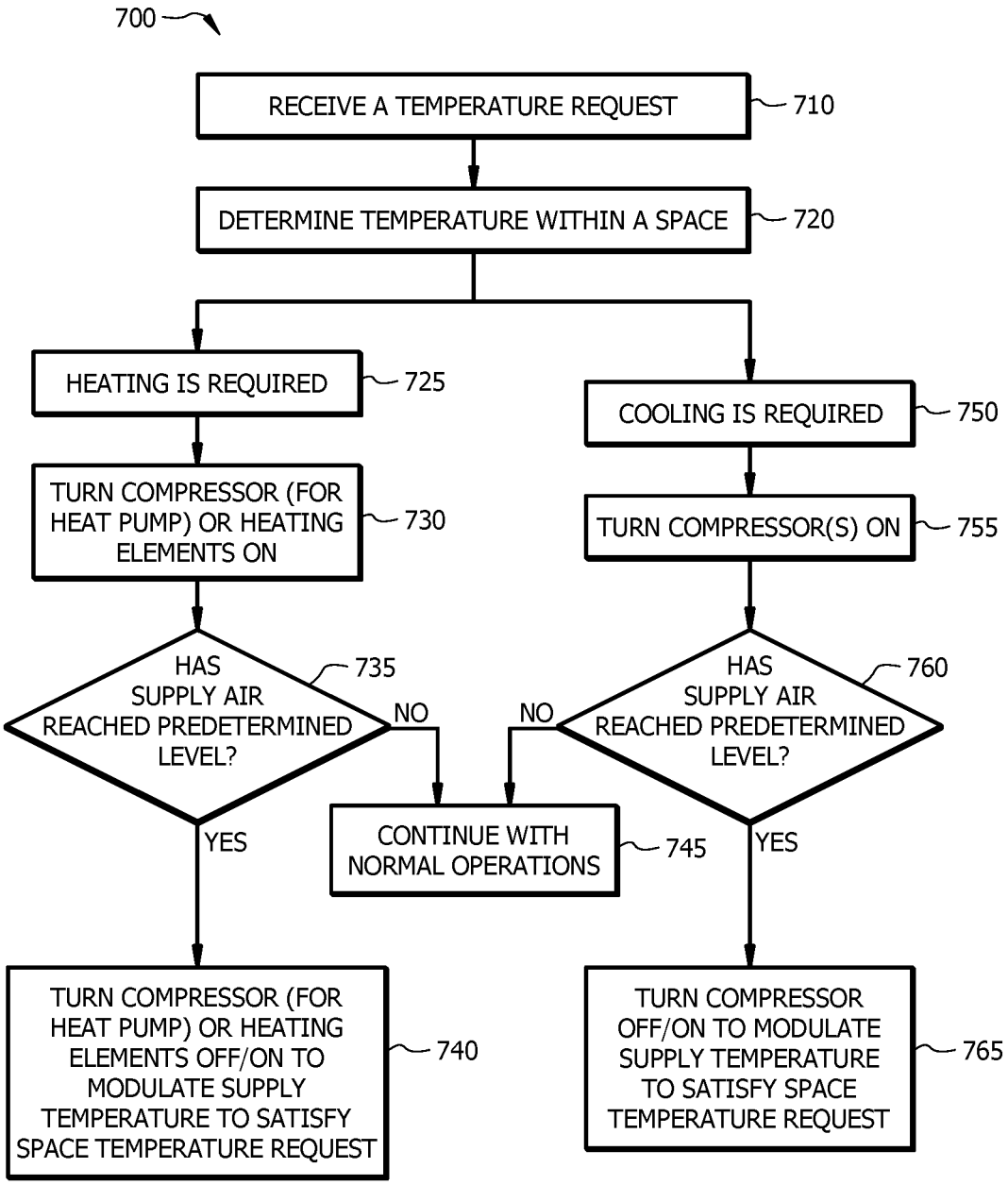
FIG. 7 is a flow-chart diagram of a possible method embodiment under the present disclosure.

A preferred method embodiment 700 under the present disclosure can be seen in FIG. 7. At 710, a temperature request is received. At 720, a temperature is determined within a space. At 725, it is determined that heating is required. At 730, the compressor for the heat pump is turned on and heating elements may be turned on. At 735, it is determined whether the sensor in the supply air has reached an predetermined level. If yes, then at 740 the compressor and/or heating elements are turned off and on to modulate supply temperature to satisfy the temperature request. If no, then at 745 the process continues with normal operations. If cooling is required instead of heating, then instead of proceeding from 720 to 725, the process proceeds to 750. At 755, compressors are turned on. At 760, it is determined if the sensor in the supply air has reached a predetermined level. If yes, then at 765 compressor(s) are turned off and on to modulate supply temperature to satisfy the temperature request. If no, then at 745 the process continues with normal operations. Turning the compressors off and on, as in method 700, or in other methods under the present disclosure, can take a variety of forms. Generally, the hotter the ambient temperature, the longer the compressors will be left on, as this helps efficiency of the system. Typically, the compressors are turned off and on depending on the resulting temperatures recorded in the space or in the supply air, or depending on another temperature reading. The modulating of the compressor operation can resemble a frequency adjusted wave, such that if resulting temperatures allow (such as in the space or supply air) for it, the compressors will be turned off on the shortest time frame allowable.

Other possible method embodiments under the present disclosure can stand on their own, or may incorporate at least a portion of method 700 into their embodiments.

Figure 2:
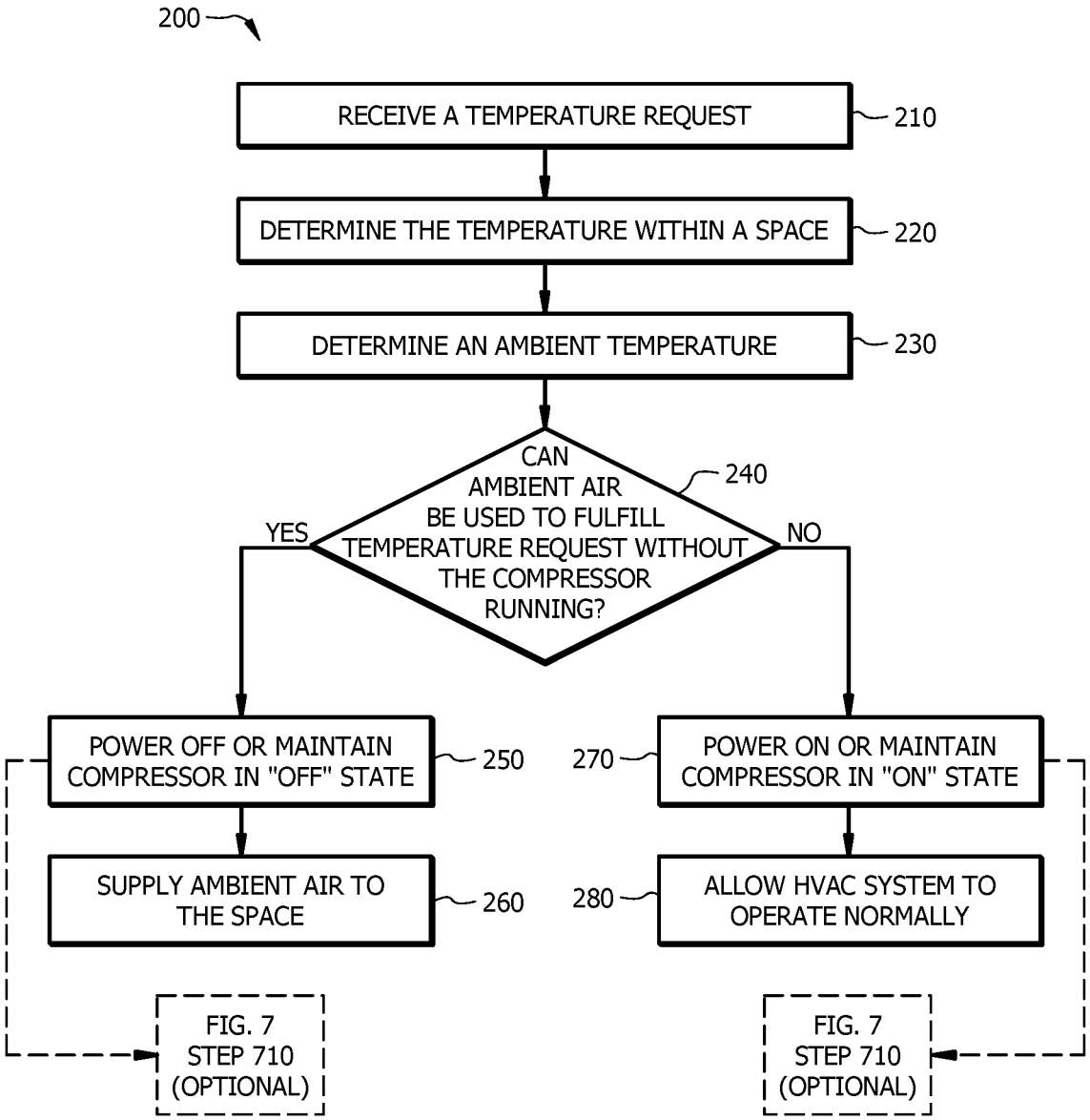
FIG. 2 is a flow-chart diagram of a possible method embodiment under the present disclosure.

FIG. 2 displays a possible method embodiment 200 under the present disclosure. At 210, a temperature request is received. At 220, the temperature within the space to be heated or cooled is determined. At 230, an ambient temperature is determined. At 240, it is determined whether ambient air can be used to fulfill the temperature request without the compressor running. If the answer is yes, then at 250 the compressor is powered off or maintained in an 'off' state. Then at 260 ambient air is supplied to the space. If the answer is no, then at 270, the compressor is powered on or maintained in an 'on' state. Then at 280, the HVAC system is allowed to operate normally in response to the temperature request. Alternatively, steps 260 and 280 can be replaced by directing the process to step 710 of method 700 of FIG. 7, and proceeding with the steps of method 700.

Figure 3:
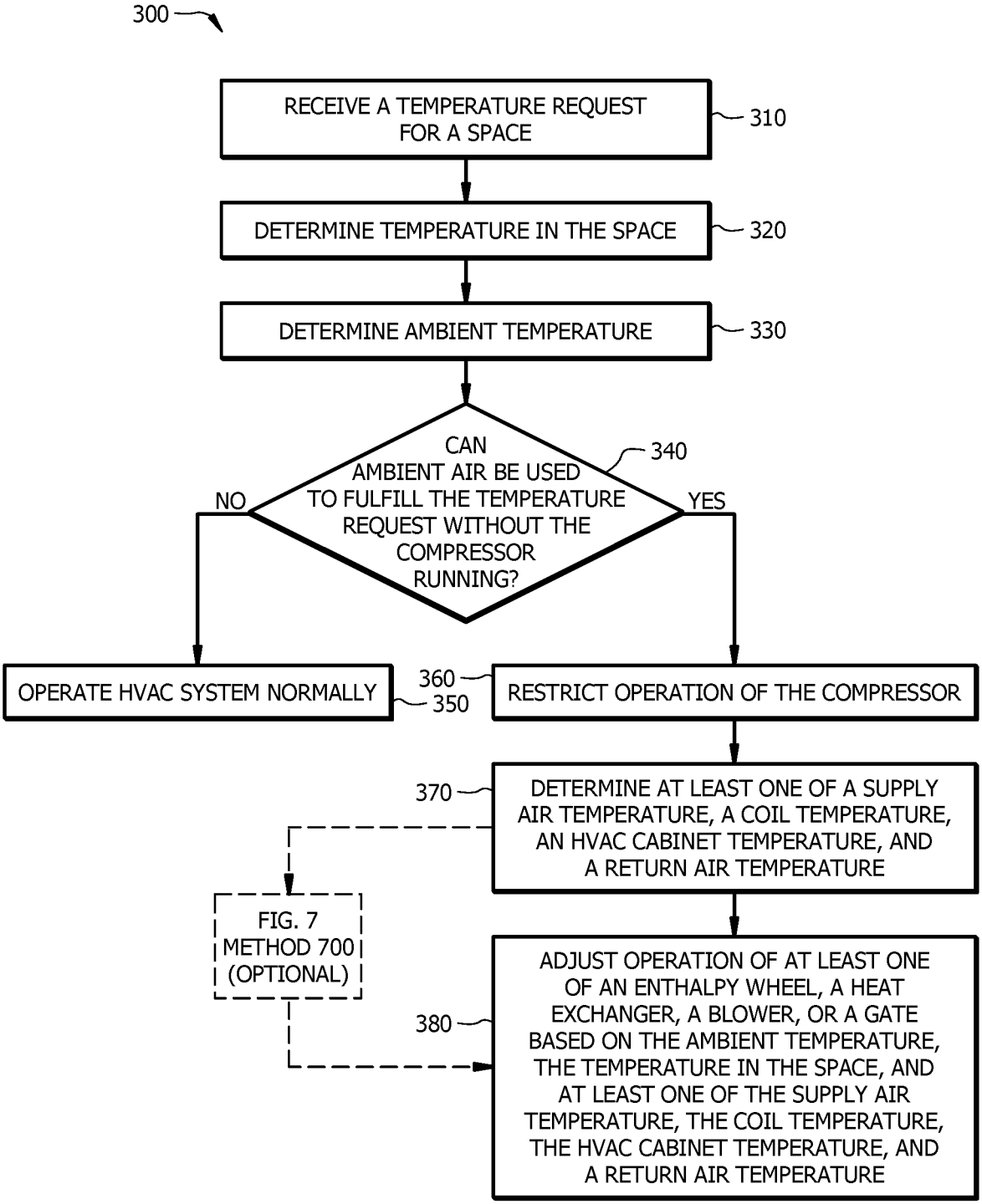
FIG. 3 is a flow-chart diagram of a possible method embodiment under the present disclosure.

FIG. 3 displays another possible method embodiment 300 under the present disclosure. At 310, a temperature request is received. At 320, a temperature is determined in the interior of a space to be conditioned. At 330, an ambient temperature is determined. At 340, it is determined whether ambient air can be used to fulfill the temperature request without the compressor running. If not, then at 350 the HVAC system is allowed to operate normally. If so, then at 360 the operation of the compressor is restricted. At 370, a determination is made of at least one of: a supply air temperature, a coil temperature, an HVAC cabinet temperature, and a return air temperature. At 380, an adjustment is made to operation of at least one of an enthalpy wheel, a heat exchanger, a blower, or a gate based on the ambient temperature, interior temperature, and at least one of a supply air temperature, a coil temperature, an HVAC cabinet temperature, and a return air temperature. Optionally, method 300 may comprise going from step 370 to step 710 method 700 of FIG. 7, processing through method 700, and then returning to step 380.

Figure 4:
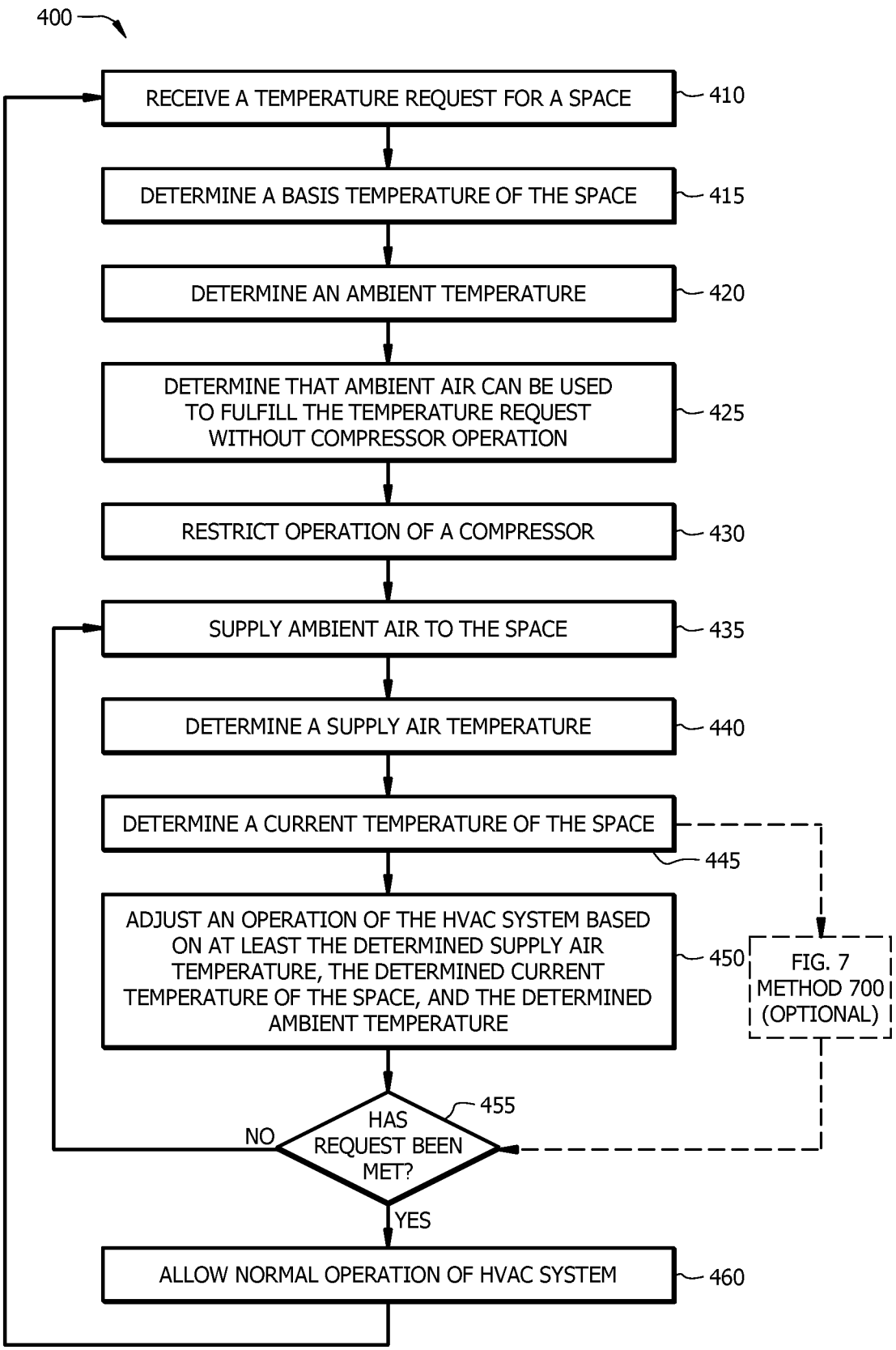
FIG. 4 is a flow-chart diagram of a possible method embodiment under the present disclosure.

FIG. 4 displays another possible embodiment of a process 400 under the present disclosure. At 410, a temperature request is received for a space. At 415, a basis temperature is determined for the space. At 420, an ambient temperature is determined. At 425, it is determined that ambient air can be used to fulfill the temperature request without compressor operation. At 430, operation of at least one compressor in the HVAC system is restricted. At 435, ambient air is supplied to the space. At 440, a supply air temperature is determined. At 445, a current space temperature is determined. At 450, an operation of the HVAC system is adjusted based on at least the determined supply air temperature, the determined current temperature of the space, and the determined ambient temperature. At 455, it is determined if the temperature request has been met. If not, then the process can return to step 435. If so, then the process can operate normally at step 460. From there the process can return to step 410 when another temperature request is received. Optionally, method 400 can comprise proceeding from step 445 to step 710 of method 700 of FIG. 7, processing through method 700, and then returning to step 455, then proceeding with method 400.

Figure 5:
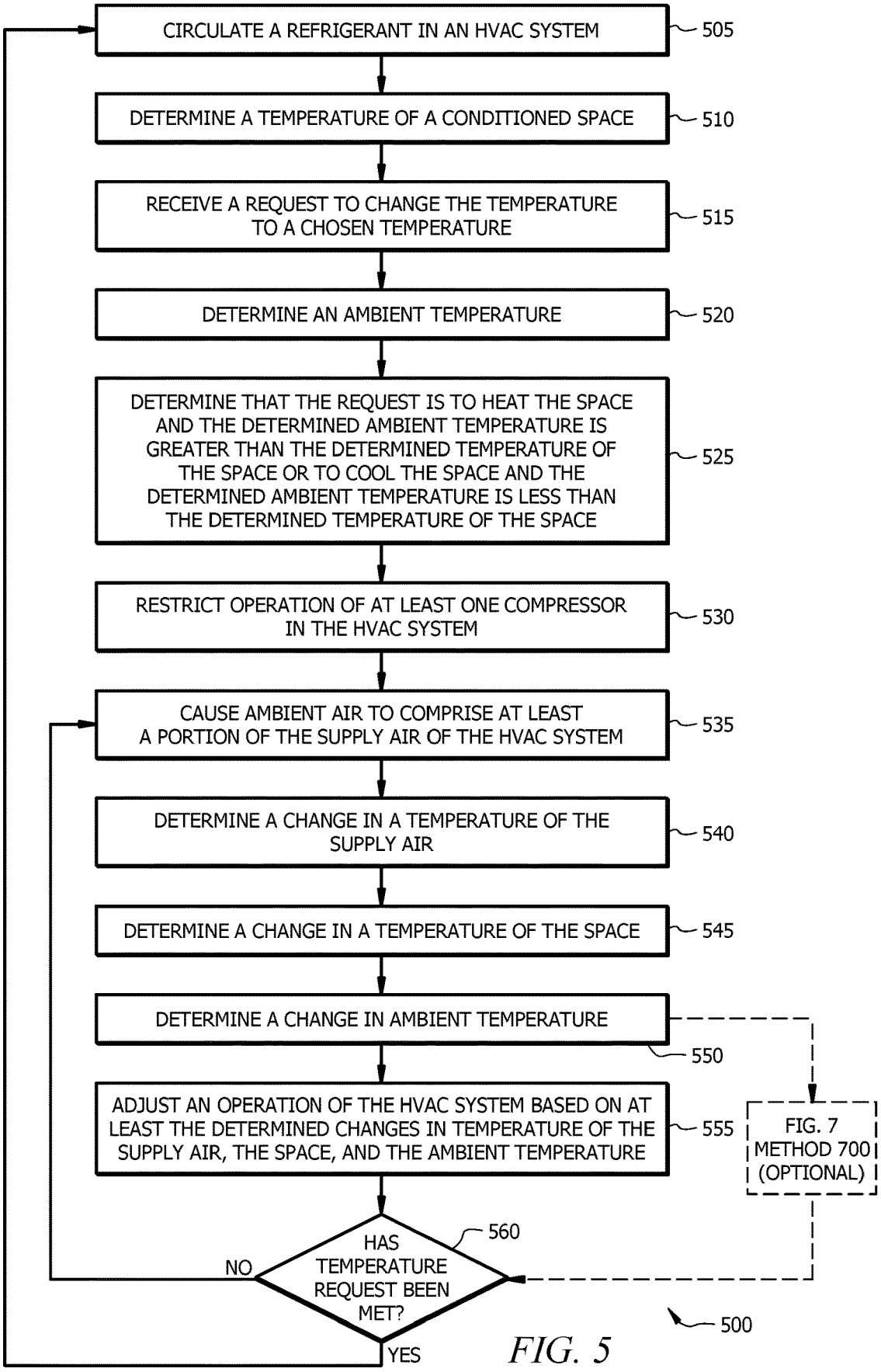
FIG. 5 is a flow-chart diagram of a possible method embodiment under the present disclosure.

FIG. 5 displays another possible embodiment of a method 500 under the present disclosure. At 505, a refrigerant or thermal transfer source (such as chilled or hot water) is circulated in an HVAC system. At 510, a temperature is determined in a conditioned space. At 515, a request is received to change the temperature to a chosen temperature. At 520, an ambient temperature is determined. At 525, a determination is made that the request is to heat the space and the determined ambient temperature is greater than the determined temperature of the space or that the request is to cool the space and the determined ambient temperature is less than the determined temperature of the space. At 530, operation of at least one compressor and/or cooling or heating process is restricted. At 535, ambient air is used for at least a portion of the supply air of the HVAC system. At 540, a change in temperature of the supply air is determined. At 545, a change in temperature of the space is determined. At 550, a change in ambient temperature is determined. These changes in temperature may be zero. At 555, an operation of the HVAC system is adjusted based on at least the determined changes in temperature of the supply air, the space, and the ambient temperature. At 560, it is determined if the temperature request has been met. If not, then the process can return to step 535. If so, the process can return to step 505. Optionally, process 500 can comprise going from step 550 to step 710 of method 700 of FIG. 7, proceeding through method 700, and then returning to step 560.

Figure 6:
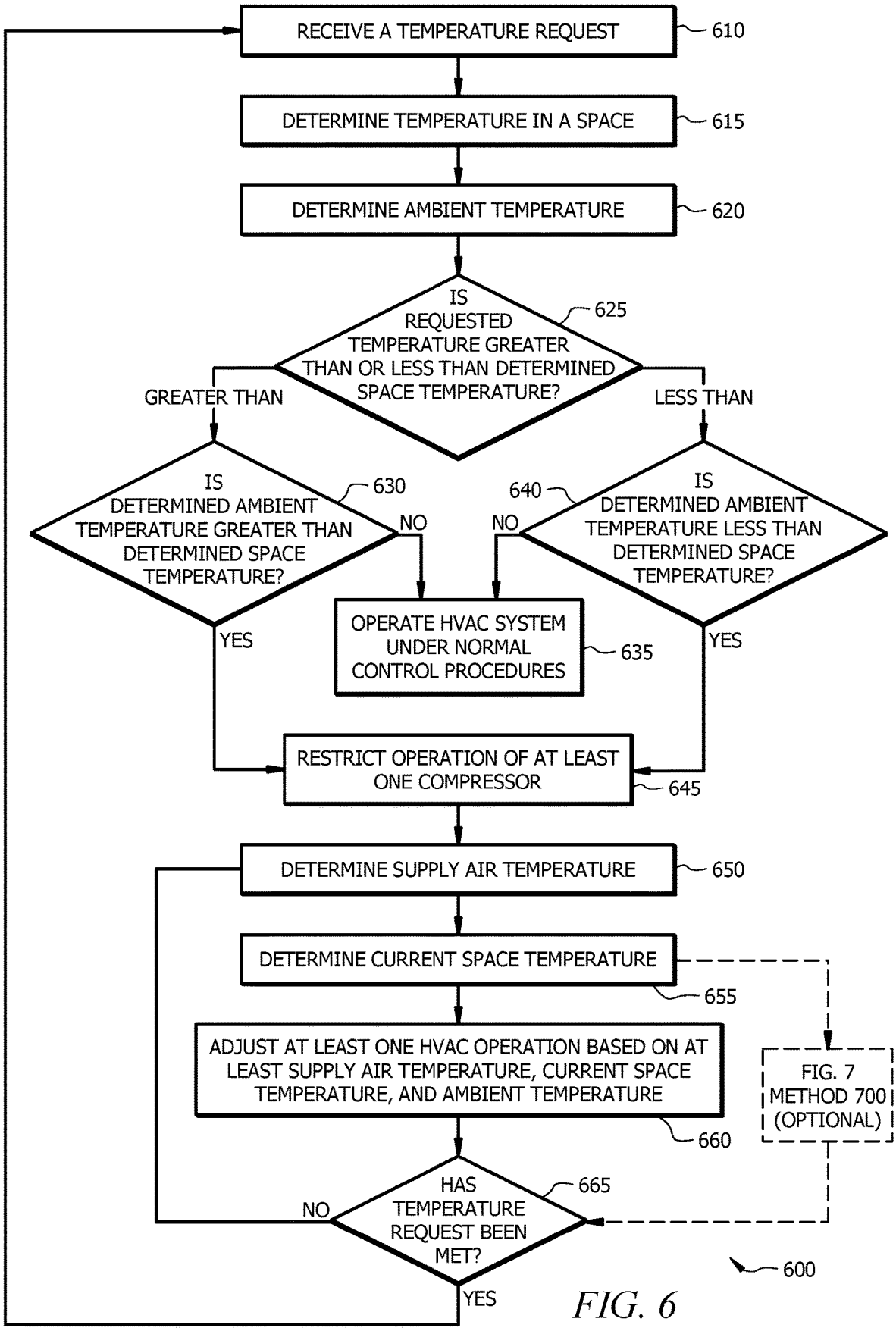
FIG. 6 is a flow-chart diagram of a possible method embodiment under the present disclosure.

FIG. 6 displays another possible embodiment of a method 600 under the present disclosure for operating an HVAC system. At 610, a temperature request is received. At 615, the temperature in a space is determined. At 620, ambient temperature is determined. In some method embodiments, such as shown partially in FIG. 7, the ambient temperature may not need to be determined. At 625, a determinations is made whether the requested temperature is greater or less than the space temperature. If greater, then at 630, it is determined if the ambient temperature is greater than the space temperature. If less, then at 640 it is determined if the ambient temperature is less than the space temperature. At either 630 or 640, if the answer is no, then the process goes to step 635 and the HVAC system is operated under normal control procedures. At 630, 640, if the answer is yes, then the process goes to step 645 and operation of at least one compressor in the HVAC system is restricted. At 650, the supply air temperature is determined. At 655, the current spaced temperature is determined. At 660, at least one operation of the HVAC system is adjusted based on at least the supply air temperature, the current space temperature, and the ambient temperature. At 665, it is determined if the temperature request has been met. If not, the process returns to step 650. If yes, then the process returns to step 610. Optionally, process 600 may go from step 655 to step 710 of method 700 of FIG. 7, proceed through method 700 and then return to step 665.

The embodiments described can be combined in a variety of ways. Method embodiments can be joined together. Temperature requests can be by direct input from a user, or also from software or settings. Remote commands can also be received by wireless or wired communication or from users using cloud software or mobile apps. Elements of, for example, FIG. 1 can be joined together via wired or wireless communication. Numerous systems of the type displayed in FIG. 1 can be joined together, and a remote command center can be in communication with the system shown or with a group of systems.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for operating an HVAC system comprising a heat exchanging coil, one or more compressors, and an HVAC controller, the method comprising:

receiving, at the HVAC controller, a temperature request for a climate controlled space;

determining a basis air temperature of the climate controlled space using at least one sensor in the climate controlled space;

determining an ambient air temperature;

determining a return air temperature using a return air sensor;

determining based on the ambient air temperature and the return air temperature that a mixture of ambient air and return air can be used to fulfill the temperature request;

restricting operation of a compressor;

supplying the mixture of ambient air and return air to the climate controlled space;

determining a supply air temperature using a sensor in the supply airstream;

determining a current temperature of the climate controlled space; and adjusting the supply air temperature by turning the compressor off and on to extract a maximum amount of energy from the heat exchanging coil and modulate the supply air temperature based on at least the determined supply air temperature, the determined current temperature of the climate controlled space, and the determined ambient temperature.

2. The method of claim 1 further comprising:

determining a humidity level in the space; and adjusting an operation of the HVAC system based on at least the determined humidity level.

3. The method of claim 1 further comprising;

determining a coil temperature and an HVAC cabinet temperature; and adjusting an operation of the HVAC system based on at least one of the determined coil temperature and the determined HVAC cabinet temperature.

4. The method of claim 1 wherein restricting operation of a compressor comprises turning off the compressor.

5. The method of claim 1 wherein adjusting an operation of the HVAC system comprises adjusting an amount of refrigerant.

6. The method of claim 1 wherein adjusting an operation of the HVAC system comprises adjusting an operation of a heat exchanger.

7. The method of claim 1 wherein adjusting an operation of the HVAC system comprises adjusting an operation of an enthalpy wheel.

8. The method of claim 1 further comprising:

determining a pressure level; and adjusting an operation of the HVAC system based on the determined pressure level.

9. An HVAC system for providing conditioned air to a space, comprising:

a cabinet comprising;

an inlet for an ambient airstream;

a supply airstream;

a return airstream; and at least one heat exchanger;

a supply air temperature sensor;

a space temperature sensor;

an ambient airstream temperature sensor;

a return airstream temperature sensor;

a controller coupled to the cabinet, supply air temperature sensor, the space temperature sensor and the ambient temperature sensor, the controller configured to receive a temperature request, wherein when the request is to heat the space when a determined ambient temperature is greater than a determined space temperature or to cool the space when the determined ambient temperature is less than the determined space temperature, the controller is configured to;

restrict operation of a compressor within the HVAC system;

allow a mixture of return air and ambient air to comprise a portion of the supply air of the HVAC system based on the ambient air temperature and return air temperature;

determine a change in the supply air temperature;

determine a change in the space temperature; and adjusting the supply air temperature by turning the compressor off and on to extract a maximum amount of energy from the heat exchanging coil and reengaging the compressor when the energy in the heat exchanging coil is insufficient to maintain the supply air temperature.

10. The HVAC system of claim 9 further comprising a humidity sensor, and wherein the controller is configured to adjust an operation of the HVAC system based on at least the determined humidity level.

11. The HVAC system of claim 9 further comprising a pressure sensor, and wherein the controller is configured to adjust an operation of the HVAC system based on the determined pressure level.

12. The HVAC system of claim 9 further comprising a heat exchanger temperature sensor and a cabinet temperature sensor, wherein the controller is configured to adjust an operation of the HVAC system based on at least one of the heat exchanger temperature and the cabinet temperature.

13. The HVAC system of claim 9 wherein the controller is a thermostat.

14. The HVAC system of claim 9 further comprising a thermostat.

* * * * *